US011377923B2

(12) United States Patent
Smith

(10) Patent No.: US 11,377,923 B2
(45) Date of Patent: Jul. 5, 2022

(54) ISOLATION DEVICE WITH INNER MANDREL REMOVED AFTER SETTING

(71) Applicant: HALLIBURTON ENERGY SERVICES, INC., Houston, TX (US)

(72) Inventor: Donald Ray Smith, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/175,781

(22) Filed: Feb. 15, 2021

(65) Prior Publication Data

US 2021/0293112 A1 Sep. 23, 2021

Related U.S. Application Data

(60) Provisional application No. 62/991,377, filed on Mar. 18, 2020.

(51) Int. Cl.

| | |
|---|---|
| ***E21B 33/124*** | (2006.01) |
| ***E21B 34/14*** | (2006.01) |
| ***E21B 17/042*** | (2006.01) |
| ***E21B 33/13*** | (2006.01) |

(52) U.S. Cl.

CPC ..... *E21B 33/124* (2013.01); *E21B 17/042* (2013.01); *E21B 33/13* (2013.01); *E21B 34/142* (2020.05)

(58) Field of Classification Search

CPC ..... E21B 33/124; E21B 33/129; E21B 33/13; E21B 34/142; E21B 17/042

See application file for complete search history.

(56) References Cited

U.S. PATENT DOCUMENTS

| | | | | |
|---|---|---|---|---|
| 5,224,540 | A | 7/1993 | Streich et al. | |
| 6,394,180 | B1 * | 5/2002 | Berscheidt | E21B 33/1294 166/135 |
| 9,976,379 | B2 | 5/2018 | Schmidt et al. | |
| 10,435,972 | B2 | 10/2019 | Crump et al. | |
| 2003/0226659 | A1 * | 12/2003 | Smith | E21B 33/1204 166/134 |
| 2016/0376869 | A1 * | 12/2016 | Rochen | E21B 33/129 166/135 |
| 2018/0230765 | A1 * | 8/2018 | Crump | E21B 23/06 |
| 2020/0332171 | A1 * | 10/2020 | Hecht | E21B 29/02 |

FOREIGN PATENT DOCUMENTS

| | | | |
|---|---|---|---|
| CN | 109072682 | A | 12/2018 |
| WO | 2015030958 | A1 | 3/2015 |

* cited by examiner

*Primary Examiner* — Christopher J Sebesta

(74) *Attorney, Agent, or Firm* — Sheri Higgins Law, PLLC; Sheri Higgins

(57) ABSTRACT

An isolation device can include a packer element that is actuated via a slip system to engage with an inner diameter of a tubing string to set the plug. The isolation device can be a frac plug. Top and bottom slip props of the slip system can be shaped such that the packer element is inhibited or prevented from engaging with an inner mandrel after the plug has been set within a wellbore. The slip props can be self-supporting; thus, the inner mandrel can be removed from the isolation device after setting and can be reused in other downhole tools. The isolation device can be used for zonal isolation to treat a zone of interest within a subterranean formation. The treatment can be a fracturing operation.

20 Claims, 4 Drawing Sheets

ISOLATION DEVICE WITH INNER MANDREL REMOVED AFTER SETTING

TECHNICAL FIELD

An isolation device and methods of using the isolation device are provided. The isolation device includes an inner mandrel that is removed from the isolation device after setting. The isolation device does not require a spacer ring to aid in the setting process as a setting sleeve has direct contact with the top slips.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1:
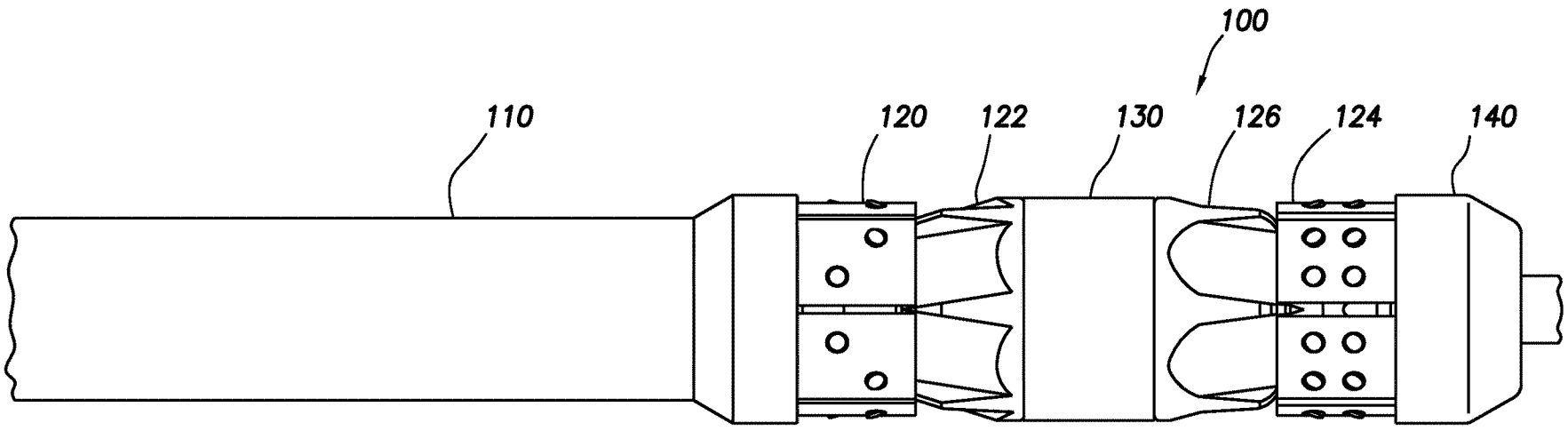
FIG. 1 is a perspective view of an isolation device in a run-in state.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals. At least one wellbore interval corresponds to a formation zone. The isolation device can be used for zonal isolation and functions to block fluid flow within a tubular section, such as a tubing string, or within an annulus. The blockage of fluid flow prevents the fluid from flowing across the isolation device in any direction and isolates the zone of interest. In this manner, treatment techniques, such as fracturing operations, can be performed within the zone of interest.

Common isolation devices include, but are not limited to, a ball and a seat, a bridge plug, a packer, a plug, a frac plug, and a wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished by dropping or flowing a ball from the wellhead onto a seat that is located within the wellbore. The ball engages with the seat, and the seal created by this engagement prevents fluid communication into other wellbore intervals downstream of the ball and seat. As used herein, the relative term "downstream" means at a location further away from a wellhead.

Plugs, for example, frac plugs, are generally composed primarily of slips, wedges, an inner plug mandrel, a spacer ring, a mule shoe, and a rubber sealing element. The plug can also include a setting device and an additional mandrel, such as a tension mandrel or setting mandrel. The plug can be introduced into the wellbore and positioned at a desired location within a tubing string. The "tubing string" can also be a casing. The plug can be set after being placed at the desired location. As used herein, the term "set" and all grammatical variations means one or more components of the plug are actuated to keep the plug at the desired location and substantially diminish or restrict fluid flow past the outside of the plug. For example, the spacer ring can be mechanically actuated to move a top slip into engagement with the inner diameter (I.D.) of the tubing string. A mule shoe, which is typically pinned and/or threaded to the inner plug mandrel, can also be mechanically actuated to move a bottom slip into engagement with the I.D. of the tubing string. Movement of the top and bottom slips can cause top and bottom wedges to mechanically actuate the rubber sealing element to expand and engage with the I.D. of the tubing string. The rubber sealing element also expands inwardly and engages with the outer diameter of the inner plug mandrel. This expansion of the rubber sealing element creates zonal isolation by substantially diminishing or restricting fluid flow around the outside of the plug. A ball can then be seated onto the plug whereby after being seated, the ball restricts fluid flow through the inner plug mandrel.

One significant disadvantage to traditional plugs is that the inner mandrel cannot be removed after setting because the inner mandrel functions to not only support the slip wedges, but also supports the rubber sealing element via direct engagement with the sealing element. The diameter of the fluid flow path through the plug can be smaller than desired because of the presence of the inner mandrel.

Isolation devices can be classified as permanent, retrievable, or drillable. While permanent isolation devices are generally designed to remain in the wellbore after use, retrievable devices are capable of being removed after use, and drillable devices are drilled or milled after use. Removal of an isolation device from the wellbore can be accomplished by milling at least a portion of the device or the entire device. Another disadvantage to traditional plugs is an increased cost and time required to mill the plug's components. Moreover, few if any of the components can be reused after milling. As such, there is a need and ongoing industry concern for improved isolation devices.

Novel plugs are disclosed. The plug can include a packer element that is actuated to engage with an I.D. of a tubing string to set the plug. Top and bottom slip props of the plug can be self-supporting and can be shaped such that the packer element is inhibited or prevented from engaging with an inner mandrel. Thus, the slip props do not require the inner mandrel for support and the inner mandrel can be removed from the plug after setting and can be reused in other downhole tools. One of the many advantages of the novel plug is that the inner diameter of the plug is enlarged due to removal of the inner mandrel. The enlarged inner diameter creates a larger fluid flow path through the plug, which allows a greater volume of fluid to flow through the plug. Moreover, if the plug needs to be milled in order to restore fluid communication into another zone, then fewer parts require milling; thus, saving time and money. The plug can be used for zonal isolation to treat a zone of interest within a subterranean formation. The treatment can be a fracturing operation. The fracturing operation can include introducing a fracturing fluid into the zone to be treated, wherein the fracturing fluid creates or enhances one or more fractures in the subterranean formation.

A zonal isolation device can include: a top slip; a top slip prop in engagement with the top slip; a bottom slip; a bottom slip prop in engagement with the bottom slip; a packer element positioned between the top slip prop and bottom slip prop, wherein movement of the top slip prop and the bottom slip prop towards each other causes the packer element to expand into engagement with an inner diameter of a tubing string; and an inner mandrel, wherein the inner mandrel is removable from the zonal isolation device after engagement of the packer element with the inner diameter of the tubing string.

Methods of isolating a zone of a subterranean formation can include: setting an isolation device within a tubing string at a desired location comprising: mechanically actuating a top slip and a bottom slip into engagement with an inner diameter of the tubing string; and causing movement of a top slip prop and a bottom slip prop towards each other, wherein the movement causes a packer element located between the top slip prop and bottom slip prop to become engaged with the inner diameter of the tubing string; and removing an inner mandrel of the isolation device after setting the isolation device within the tubing string at the desired location.

It is to be understood that the discussion of any of the embodiments regarding the plug is intended to apply to all of the method and apparatus embodiments without the need to repeat the various embodiments throughout. Any reference to the unit "gallons" means U.S. gallons.

Turning to the Figures, FIG. 1 shows an isolation device 100 in a run-in position according to any of the embodiments. As used herein, the terms "run into" and "run in" mean the isolation device plug is capable of being moved within a tubing string to a desired location and/or the time during which the isolation device is being introduced into a wellbore at a desired location. The isolation device 100 can be a plug. The plug can be used in an oil and gas operation. The oil or gas operation can be a fracturing operation or for zonal isolation. The isolation device 100 can be a frac plug, bridge plug, or zonal isolation plug. There can also be more than one isolation device 100 that is run into a tubing or casing string to provide zonal isolation.

As shown in FIG. 1, the isolation device 100 can include top slips 120, a top slip prop 122, a packer element 130, a bottom slip prop 126, bottom slips 124, an inner mandrel 114 (shown in FIG. 2), and a mule shoe 140. The components of the plug can be made from a variety of materials including, but not limited to, metals, metal alloys, dissolvable materials, molded hardened polymers, resins, or resin/glass composites. Examples of metals or metal alloys that can be used include, but are not limited to, cast iron and aluminum. The packer element 130 can be made from elastomeric materials including, but not limited to, natural rubbers, styrene-butadiene block copolymers, polyisoprene, polybutadiene, ethylene propylene rubber, ethylene propylene diene rubber, silicone elastomers, fluoroelastomers, polyurethane elastomers, nitrile rubbers, and dissolvable, elastomeric materials. The components of the isolation device can have a variety of dimensions that are selected for the particular wellbore operation in which the isolation device is used.

The isolation device 100 can include a slip system located on the outside of the inner mandrel 114. As shown in the Figures, the inner mandrel 114 can extend from an area below the mule shoe 140, through the inner diameter of the device, and to an area above the top slips 120. The slip system includes the top slips 120 and the bottom slips 124. The slips 120/124 can be made from a single cylinder of material, a set of slips retained in a groove on the slip prop, or a single cylinder of material containing a plurality of slots or grooves. The slips 120/124 can be located around a portion of the outside of the inner mandrel 114 and radially biased towards the outside of the inner mandrel 114. The slips 120/124 can have buttons or teeth on its face. As used herein, the terms "button" and "teeth" include one or more elements that are capable of grippingly engaging an inner diameter (I.D.) 161 of a tubing string or casing 160 to retain the isolation device 100 in a set position. The buttons or teeth can include sharp ridges machined onto the face of the slips 120/124 or sharp elements, for example, rounded or other geometric shapes that are attached to the face of the slips 120/124. The slip system can further include slip props.

Figure 2:
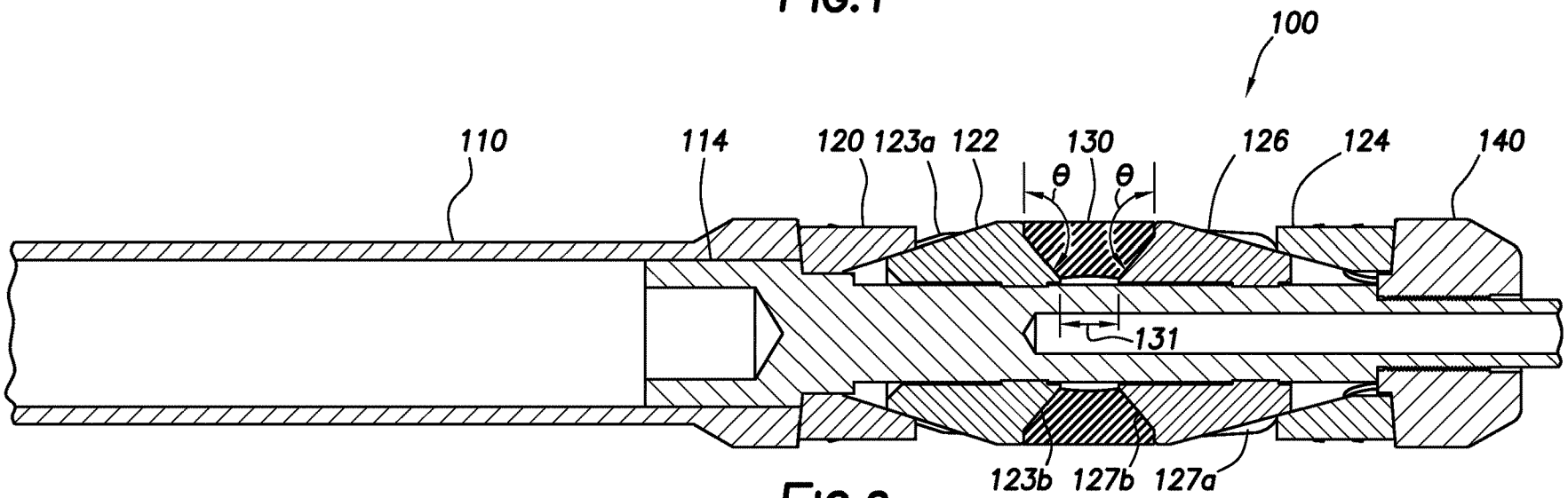
FIG. 2 is a cross-sectional view of the isolation device of FIG. 1.

As shown in FIG. 2, an upper and a lower end of each of the slips 120/124 can be formed having a conical or ramped surface. The surfaces of the slips 120/124 allow a parallel, angled surface 123*a* of a top slip prop 122 and a parallel, angled surface 127*a* of a bottom slip prop 126 to slidingly engage with the ramped surfaces of the slips 120/124. In one position, the slips 120/124 can be positioned substantially adjacent to the inner mandrel 114 and axially separated from the top slip prop 122 and bottom slip prop 126 so that the outer diameter (O.D.) of the slips 120/124 is less than or equal to the O.D. of the slip props 122/126. As used herein, the term "slip prop" includes a wedge, cone, or any device that can support the slips 120/124 when the isolation device 100 is set.

Figure 3:
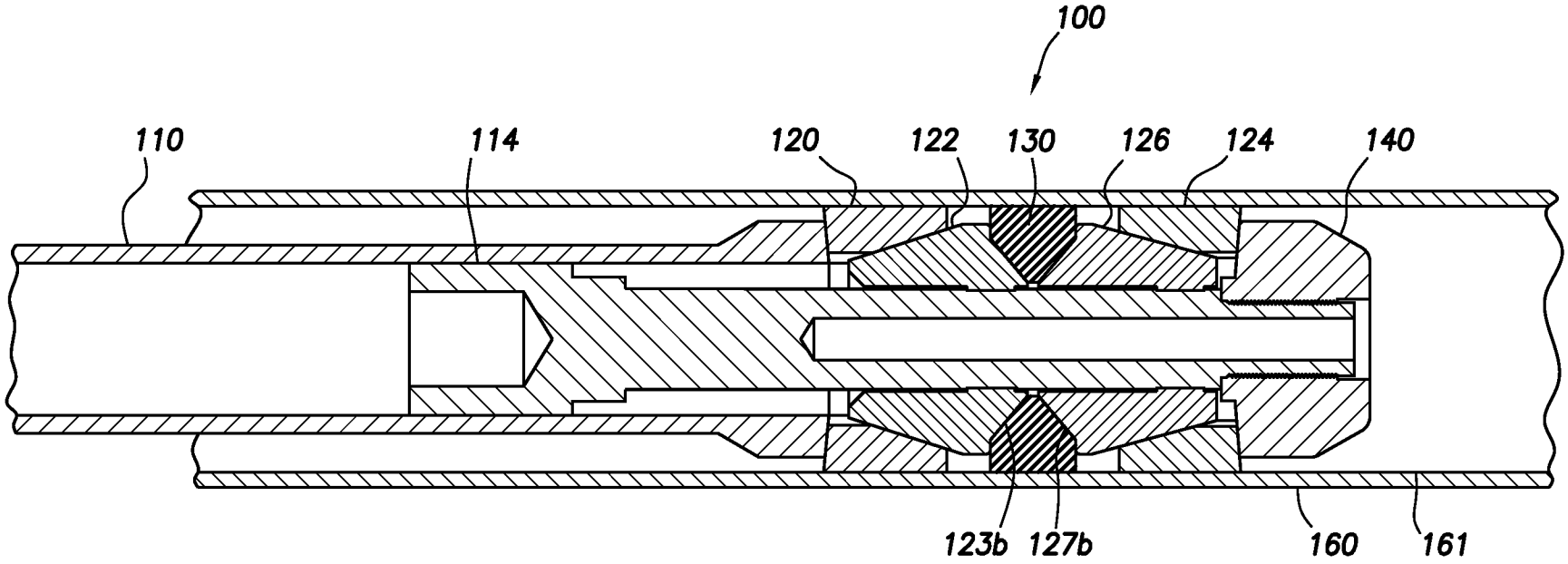
FIG. 3 is a cross-sectional view of the isolation device of FIG. 1 after being set.

After the isolation device 100 is run in the wellbore to a desired location, it can be set. FIG. 3 shows the isolation device 100 after setting. The isolation device 100 can be mechanically set using wireline or hydraulic setting tools, for example. Unlike conventional isolation device plugs that are set using a spacer ring, the isolation device 100 according to any of the embodiments can also include a setting sleeve 110. The setting sleeve 110 can be attached to a setting tool (not shown). The inner mandrel 114 can also be attached to the setting tool, such that after setting, the inner mandrel 114 and the setting sleeve 110 can be removed from the wellbore—leaving only the slip system and the packer element within the wellbore.

Setting the isolation device 100 can involve applying compression to a slip system to move the slips 120/124 axially towards and along the face of the slip props 122/126 and radially away from the inner mandrel 114 and into engagement with the I.D. 161 of the tubing string or casing 160 and to allow the top slips 120 to maintain engagement with the tubing string or casing 160. The setting sleeve 110 can be mechanically actuated. The force applied to the device can increase the load on the slips 120/124 causing them to break via the slots or grooves (shown in FIG. 1) and ramp up the angled surfaces 123*a*/127*a* of the slip props 122/126 towards each other. Compression that is applied to the slip system causes the top slips 120 to move along the top slip prop 122, which in turn causes a lower end of the mule shoe 140 to move towards the top slips 120. Movement of the mule shoe 140 causes the bottom slips 126 to move along the bottom slip prop 126. The slip props 122/126 can support the slips 120/124 in an expanded position outward from the inner mandrel 114 such that the slips 120/124 engage the I.D. 161 of the tubing string or casing 160 when the isolation device 100 is set. The slip props 122/126 can prevent the slips 120/124 from retracting and releasing from the I.D. 161 of the tubing string once the isolation device 100 is set. When the slips 120/124 are engaged with the tubing string or casing 160, the isolation device 100 has substantially limited or no vertical movement within the wellbore.

Setting the isolation device 100 can further involve causing the packer element 130 to expand radially away from the inner mandrel 114 to form a pressure tight annular seal. The packer element 130 can radially expand outwardly away from the inner mandrel 114 to engage with an inner diameter 161 of the tubing string or casing 160 when the isolation device 100 is set. Downward movement of the setting sleeve 110 and the upward movement of the mule shoe 140 causes the slip props 122/126 to move towards each other and axially compresses the packer element 130 to cause it to expand into engagement with the I.D. 161 of the tubing string or casing 160. Engagement of the packer element 130 with the inside of the tubing string or casing 160 can preferably restrict fluid flow past the packer element.

As shown in FIG. 2, the packer element 130 has a width 131 between the top slip prop 122 and the bottom slip prop 126 adjacent to the inner mandrel 114. During setting of the isolation device 100, movement of the slip props 122/126 towards each other decreases the width 131 after setting as shown, for example, in FIG. 3.

According to any of the embodiments, the packer element 130 does not engage the inner mandrel 114 after the isolation device 100 is set. Still with reference to FIGS. 2 and 3, the top slip prop 122 can include a second angled surface 123*b* and the bottom slip prop 126 can include a second angled surface 127*b*. The angle denoted in the drawings as θ (theta) of the angled surfaces 123*b*/127*b* can be selected such that after setting, the packer element 130 is inhibited or prevented from engaging with the inner mandrel 114. By way of example, the angle θ can be in the range of 100° to 170°. In this manner, expansion of the packer element 130 is in a direction away from the inner mandrel 114, and the packer element 130 is substantially prevented from being in direct engagement with the inner mandrel 114. Traditional plugs generally have an angle θ that is greater than 180°—that is, the slip prop's angle in an opposite direction as shown in the Figures. An angle θ greater than 180° allows the packer element to expand towards the inner mandrel and engage with the inner mandrel after setting.

Figure 4:
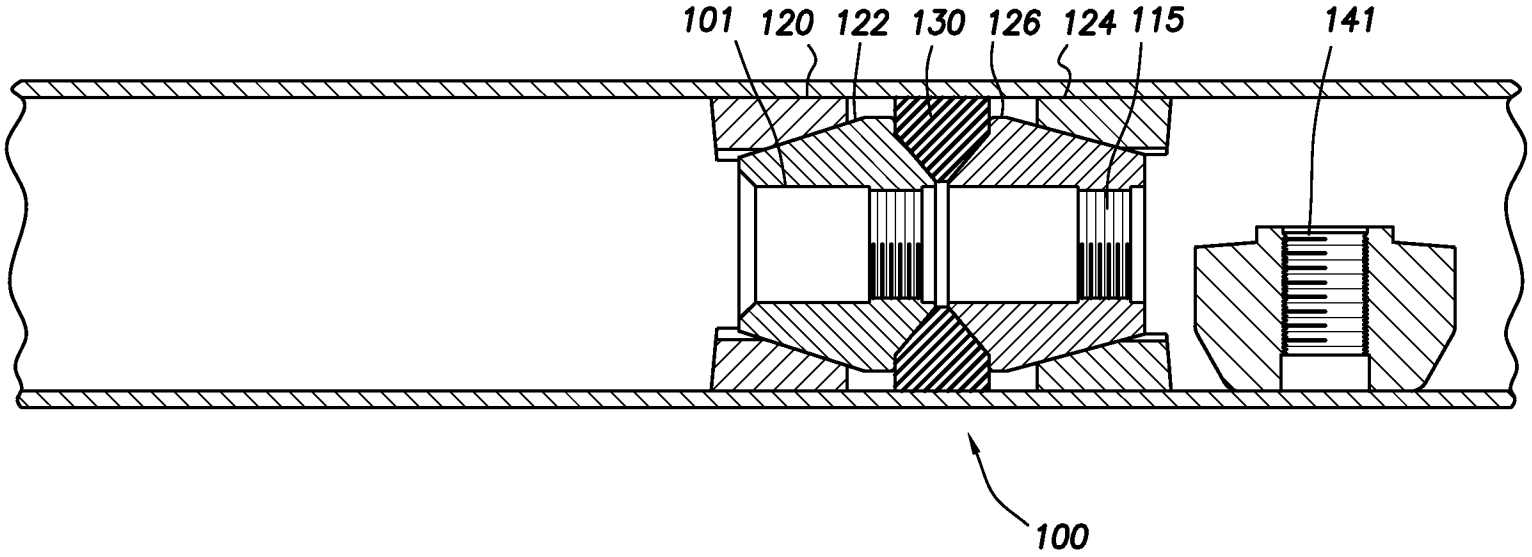
FIG. 4 is a cross-sectional view of the isolation device showing a mule shoe being sheared from the device after setting.

As shown in FIG. 4, the mule shoe 140 can include threads 141 for connecting the mule shoe 140 to the inner mandrel 114 via threads 115 on the inner mandrel 114. As also shown, the slip props 122/126 can include threads to connect to the inner mandrel 114 during the run-in position. The threads on the slip props 122/126 can be located on the slip props as shown in one embodiment in FIG. 4 and in a second embodiment in FIG. 5—although the threads can be located in a different area from shown in the Figures. The slip props 122/126 do not have to include threads for connecting to the inner mandrel 114. Continued force applied to the slip system can cause the slip props 122/126 to shear from the inner mandrel 114 when threads are included. The shear force required to shear the slip props 122/126 from the inner mandrel 114 can be less than the force required to shear the mule shoe 140 from the inner mandrel 114. Continued force applied to the slip system also causes movement of the slips 120/124, the slip props 122/126, and the packer element 130. When the slips 120/124, the slip props 122/126, and the packer element 130 have moved into the fully set position, for example as shown in FIGS. 3 and 4, the force being applied no longer causes movement of the components. The system then reaches a predetermined force that shears the mule shoe 140 from engagement with the inner mandrel 114, for example as shown in FIG. 4. After the isolation device 100 has been set and the mule shoe 140 has been sheared, the setting sleeve 110 and the inner mandrel 114 can be removed from the wellbore. The step of removing can include removing the setting tool (not shown) that is connected to the setting sleeve and inner mandrel. The setting sleeve 110 and inner mandrel 114 can be removed, in part, because the packer element 130 is not in direct engagement with the inner mandrel 114 after setting.

The isolation device 100 can include a fluid flow path defined by an inner diameter 101 of the isolation device 100. The flow path through the inner diameter of the isolation device can allow fluids to flow from or into the subterranean formation via a conduit defined by the tubing string or casing 160. According to any of the embodiments, the isolation device 100 has a substantially (i.e., +/−10%) uniform inner diameter after removal of the inner mandrel. By way of example, the top slip prop 122 and the bottom slip prop 126 can have substantially the same dimensions and form a substantially straight line that forms an inner diameter of the device after removal of the inner mandrel 114. Accordingly, the inner diameter of the device after removal of the inner mandrel is not tapered or staggered.

The isolation device 100 can include a staggered or tapered inner diameter 101. The inner diameter 101 can be smaller at an area downstream of the direction of fluid flow. In this manner a ball 150 (e.g., a frac ball) can be flowed through the tubing string or casing 160 into the isolation device 100 and become seated within the isolation device 100 when the ball 150 encounters the smaller inner diameter.

The slip props 122/126 are self-supporting after removal of the inner mandrel 114. As used herein, the term "self-supporting" means the slip props do not require a reinforcing element, such as a mandrel, in order to maintain structural integrity and a fixed position. Thus, the slip props are able to maintain the slips in engagement with the I.D. of the tubing string without the need for a mandrel or other component to support the slip props from the inside of device. This self-support can be achieved by increasing the thickness (as measured from the I.D. to the O.D.) of the slip props 122/126. Traditional plugs that require an inner mandrel to support the slip props in a set position necessitate use of thinner slip props in order to accommodate the inner mandrel while still providing a fluid flow path through the plug. The novel device disclosed allows a larger diameter fluid flow path due to removal of the inner mandrel 114 after setting, while still providing thicker slip props 122/126 that are self-supporting.

Figure 5:
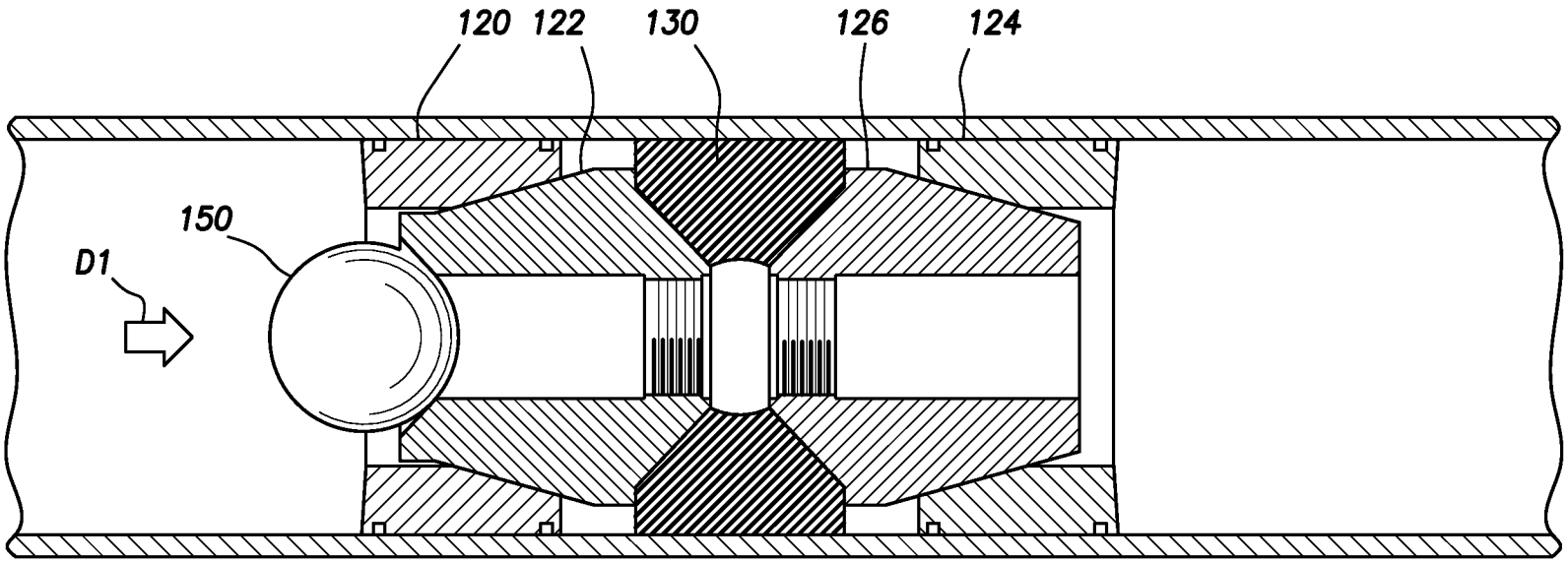
FIG. 5 is a cross-sectional view of the isolation device showing a frac ball seated at the top of the isolation device.

The fluid flow path through the device can be closed. As seen in FIG. 5, a ball 150 can become seated onto the top slip prop 122 when fluid flow is in the direction D1. According to these embodiments, the ball 150 can have an outer diameter that is greater than the inner diameter 161 of a top end of the top slip prop. According to certain embodiments, the ball does not seat within the isolation device after the inner mandrel is removed. It is to be understood that the relative terms "top" and "bottom" are used for convenience purposes and are not meant to indicate a specific orientation. For example, the ball 150 can seat against the bottom slip prop 126 if fluid flow is in a direction opposite of D1.

When desired, fluid flow can be restored through the inner diameter of the isolation device 100. By way of example, if the ball 150 is seated by flowing the ball in the direction D1, then fluid flow can be restored by flowing a fluid in the opposite direction, which will unseat the ball 150. One of the many advantages to the novel isolation device 100 is that fluid flow through the device is increased compared to conventional plugs because the inner diameter of the plug is greater without the inner mandrel 114 being present after setting.

All or a portion of the isolation device 100 can be removed from the tubing string when desirable. Removal can be accomplished by drilling, milling, or dissolving the components of isolation device 100. Another advantage to the novel device is the time for removal is decreased because there are fewer components (e.g., the setting sleeve and inner mandrel) to remove compared to conventional plugs.

Methods of providing zonal isolation can include some or all of the following: introducing the isolation device 100 into a tubing string or casing 160; setting the isolation device 100 at a desired location within the tubing string or casing 160; shearing the mule shoe 140; removing the setting sleeve 110 and the inner mandrel 114; seating a ball 150 against the isolation device 100; performing a treatment operation within the isolated zone; unseating the ball 150; and removing all or a portion of the isolation device 100.

The methods can further include fracturing a portion of a subterranean formation that is penetrated by the wellbore. The step of fracturing can include introducing a fracturing fluid into a zone of the formation, wherein the fracturing fluid creates or enhances a fracture in the formation.

An embodiment of the present disclosure is a zonal isolation device comprising: a top slip; a top slip prop in engagement with the top slip; a bottom slip; a bottom slip prop in engagement with the bottom slip; a packer element positioned between the top slip prop and bottom slip prop, wherein movement of the top slip prop and the bottom slip prop towards each other causes the packer element to expand into engagement with an inner diameter of a tubing string; an inner mandrel, wherein the inner mandrel is removable from the zonal isolation device after engagement of the packer element with the inner diameter of the tubing string; and a ball, wherein the ball is seated onto the top slip prop. Optionally, the device further comprises wherein the isolation device is a frac plug, bridge plug, or zonal isolation plug. Optionally, the device further comprises a setting sleeve, wherein the setting sleeve and the inner mandrel are connecting to a setting tool. Optionally, the device further comprises wherein the top slip prop comprises a first angled surface for engaging with the top slip and a second angled surface, and wherein the bottom slip prop comprises a first angled surface for engaging with the bottom slip and a second angled surface. Optionally, the device further comprises wherein the packer element is located between the second angled surface of the top slip prop and the second angled surface of the bottom slip prop. Optionally, the device further comprises wherein the second angled surface of the top slip prop and the bottom slip prop forms an angle, and wherein the angle is in the range of 100° to 170°. Optionally, the device further comprises a mule shoe, and wherein the mule shoe comprises threads for connecting the mule shoe to a bottom end of the inner mandrel via threads on the inner mandrel. Optionally, the device further comprises wherein the top slip prop and the bottom slip prop are self-supporting after removal of the inner mandrel. Optionally, the device further comprises wherein the zonal isolation device has a substantially uniform inner diameter after removal of the inner mandrel.

Another embodiment of the present disclosure is a method of isolating a zone of a subterranean formation comprising: setting an isolation device within a tubing string at a desired location comprising: mechanically actuating a top slip and a bottom slip into engagement with an inner diameter of the tubing string; and causing movement of a top slip prop and a bottom slip prop towards each other, wherein the movement causes a packer element located between the top slip prop and bottom slip prop to become engaged with the inner diameter of the tubing string; removing an inner mandrel of the isolation device after setting the isolation device within the tubing string at the desired location; and causing a ball to seat onto the top slip prop. Optionally, the method further comprises wherein mechanically actuating the top slip and the bottom slip comprises applying compression to a slip system to move the top slip and the bottom slip axially towards and along a first angled surface of the top slip prop and a first angled surface of the bottom slip prop and radially away from the inner mandrel. Optionally, the method further comprises wherein movement of the top slip along the first angled surface of the top slip prop causes a mule shoe that is connected to a bottom end of the inner mandrel to move towards the top slip. Optionally, the method further comprises wherein the top slip prop further comprises a second angled surface, wherein the bottom slip prop further comprises a second angled surface, and wherein the packer element is located between the second angled surface of the top slip prop and the second angled surface of the bottom slip prop. Optionally, the method further comprises wherein the second angled surface of the top slip prop and the bottom slip prop forms an angle, and wherein the angle is in the range of 100° to 170°. Optionally, the method further comprises a mule shoe, and wherein the mule shoe comprises threads for connecting the mule shoe to a bottom end of the inner mandrel via threads on the inner mandrel. Optionally, the method further comprises shearing the mule shoe from engagement with the inner mandrel, wherein after the isolation device has been set within the tubing string at the desired location, continued application of the compression shears the mule shoe. Optionally, the method further comprises wherein the inner mandrel is removed from the tubing string after the mule shoe has sheared. Optionally, the method further comprises wherein the top slip prop and the bottom slip prop are self-supporting after removal of the inner mandrel. Optionally, the method further comprises wherein the isolation device has a substantially uniform inner diameter after removal of the inner mandrel. Optionally, the method further comprises wherein the ball has a larger outer diameter than the inner diameter of a top end of the top slip prop.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more surfaces, slips, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A zonal isolation device comprising:

a top slip;

a top slip prop in engagement with the top slip, wherein the top slip prop comprises a first terminal end and a second internal end, and wherein the first terminal end of the top slip prop comprises a ball seat;

a bottom slip;

a bottom slip prop in engagement with the bottom slip, wherein the bottom slip prop comprises a first terminal end and a second internal end;

a packer element positioned between the second internal end of the top slip prop and the second internal end of the bottom slip prop, wherein movement of the top slip prop and the bottom slip prop towards each other causes the packer element to expand into engagement with an inner diameter of a tubing string;

an inner mandrel, wherein the inner mandrel is removable from the zonal isolation device after engagement of the packer element with the inner diameter of the tubing string; and a ball, wherein the ball is seated onto the ball seat of the first terminal end of the top slip prop.

2. The device according to claim 1, wherein the isolation device is a frac plug, bridge plug, or zonal isolation plug.

3. The device according to claim 1, further comprising a setting sleeve, wherein the setting sleeve and the inner mandrel are connecting to a setting tool.

4. The device according to claim 1, wherein the top slip prop comprises a first angled surface for engaging with the top slip and a second angled surface, and wherein the bottom slip prop comprises a first angled surface for engaging with the bottom slip and a second angled surface.

5. The device according to claim 4, wherein the packer element is located between the second angled surface of the top slip prop and the second angled surface of the bottom slip prop.

6. The device according to claim 5, wherein the second angled surface of the top slip prop and the bottom slip prop forms an angle, and wherein the angle is in the range of 100° to 170°.

7. The device according to claim 1, further comprising a mule shoe, and wherein the mule shoe comprises threads for connecting the mule shoe to a bottom end of the inner mandrel via threads on the inner mandrel.

8. The device according to claim 1, wherein the top slip prop and the bottom slip prop are self-supporting after removal of the inner mandrel.

9. The device according to claim 1, wherein the top slip prop and the bottom slip prop have a substantially uniform inner diameter relative to each other after removal of the inner mandrel.

10. A method of isolating a zone of a subterranean formation comprising:

setting an isolation device within a tubing string at a desired location comprising:

mechanically actuating a top slip and a bottom slip into engagement with an inner diameter of the tubing string; and causing movement of a top slip prop and a bottom slip prop towards each other, wherein the movement causes a packer element located between a second internal end of the top slip prop and a second internal end of the bottom slip prop to become engaged with the inner diameter of the tubing string;

removing an inner mandrel of the isolation device after setting the isolation device within the tubing string at the desired location; and causing a ball to seat onto a ball seat located on a first terminal end of the top slip prop.

11. The method according to claim 10, wherein mechanically actuating the top slip and the bottom slip comprises applying compression to a slip system to move the top slip and the bottom slip axially towards each other, along a first angled surface of the top slip prop and a first angled surface of the bottom slip prop, and radially away from the inner mandrel.

12. The method according to claim 11, wherein movement of the top slip along the first angled surface of the top slip prop causes a mule shoe that is connected to a bottom end of the inner mandrel to move towards the top slip.

13. The method according to claim 11, wherein the top slip prop further comprises a second angled surface, wherein the bottom slip prop further comprises a second angled surface, and wherein the packer element is located between the second angled surface of the top slip prop and the second angled surface of the bottom slip prop.

14. The method according to claim 13, wherein the second angled surfaces of the top slip prop and the bottom slip prop forms an angle, and wherein the angle is in the range of 100° to 170°.

15. The method according to claim 11, further comprising a mule shoe, and wherein the mule shoe comprises threads for connecting the mule shoe to a bottom end of the inner mandrel via threads on the inner mandrel.

16. The method according to claim 15, further comprising shearing the mule shoe from engagement with the inner mandrel, wherein after the isolation device has been set within the tubing string at the desired location, continued application of the compression shears the mule shoe.

17. The method according to claim 16, wherein the inner mandrel is removed from the tubing string after the mule shoe has sheared.

18. The method according to claim 10, wherein the top slip prop and the bottom slip prop are self-supporting after removal of the inner mandrel.

19. The method according to claim 10, wherein the top slip prop and the bottom slip prop have a substantially uniform inner diameter relative to each other after removal of the inner mandrel.

20. The method according to claim 10, wherein the ball has a larger outer diameter than the inner diameter of the ball seat located at the first terminal end of the top slip prop.

* * * * *